United States Patent [19]

Suverison

[11] 4,174,879

[45] Nov. 20, 1979

[54] ELECTRICAL CONNECTOR

[75] Inventor: Lyle B. Suverison, Fowler, Ohio

[73] Assignee: General Motors Corporation, Detroit, Mich.

[21] Appl. No.: 919,802

[22] Filed: Jun. 28, 1978

[51] Int. Cl.[2] ..... H01R 9/12; H01R 13/98; H01R 13/54

[52] U.S. Cl. ..... 339/217 S; 339/61 R; 339/91 R

[58] Field of Search ..... 339/54, 61 R, 61 L, 339/75 R, 91 R, 196 R, 196 A, 213 S, 255 B, 255 P, 258 R, 261

[56] References Cited

U.S. PATENT DOCUMENTS

| | | | |
|---|---|---|---|
| 2,036,461 | 4/1936 | Darby | 339/255 P X |
| 2,484,525 | 10/1949 | Norris | 339/74 R |
| 3,207,536 | 9/1965 | Lawrence | 339/91 R X |
| 3,368,182 | 2/1968 | Culver | 339/91 R |
| 3,740,703 | 6/1973 | Sessions | 339/261 X |

*Primary Examiner*—E. F. Desmond
*Attorney, Agent, or Firm*—Donald F. Scherer

[57] ABSTRACT

The drawings illustrate an electrical connector including a conventional electrical connector body portion having a metal terminal secured therein and having an open-ended notch formed adjacent the terminal for sliding engagement with an external terminal post. A lock member portion includes a rigid arm integrally formed along one edge of the connector body portion, and a movable arm integrally pivotally connected at a midpoint thereof to the rigid arm and extending along an opposite edge of the connector body portion. An inwardly projecting locking corner is formed on the end of the movable arm adjacent the open-ended notch, adapted to being flexed outwardly by the movement therepast of the external terminal post upon the forcing of the connector body portion onto the terminal post for locking engagement with the terminal. Finger grips are formed on the outer edge of the other end of each of the rigid and movable arms adapted to pivot the locking corner outwardly away from the rigid arm in response to manual depression of the finger grips for release of the connector body portion from the terminal post.

2 Claims, 6 Drawing Figures

ELECTRICAL CONNECTOR

This invention relates generally to electrical connectors and, more particularly, to electrical connectors having releasable locking means associated therewith.

Heretofore, various electrical connector designs have included locking means for cooperation with terminal posts or studs, for example, Culver U.S. Pat. No. 3,368,182 and Lawrence U.S. Pat. No. 3,207,536. However, while such arrangements have performed satisfactorily, they have generally included a push-pull bayonet-type coupling with one member thereof including integral pivotable arms which are normally spread apart until slid axially into a suitable outer sleeve member and around a terminal post. There is a need for a one-piece simplified electrical connector which is adapted to being quickly and efficiently releasably engaged with a conventional terminal post.

Accordingly, a general object of the invention is to provide an improved electrical connector which satisfies the above need.

Another object of the invention is to provide an improved one-piece electrical connector having one rigid locking arm and one movable locking arm integrally pivotally connected to the rigid arm and to the connector body, the latter adapted to having a metal terminal secured therein for cooperative releasable engagement with a terminal post via the locking arms.

A further object of the invention is to provide an electrical terminal including a plastic body portion having a metal terminal secured therein and an open-ended notch formed in a wall thereof adjacent the terminal for sliding engagement with an external terminal post, and a locking portion including a rigid arm integrally formed along one edge of the wall and an adjacent movable arm integrally pivotally connected to the rigid arm, with an inwardly projecting locking corner formed on one end of the movable arm adapted to being flexed outwardly by the movement therepast of the external terminal post upon the forcing of the connector body onto the post for locking engagement with the terminal, and finger grip means formed on the outer edge of the other end of each of the rigid and movable arms adapted to pivot the locking corner outwardly away from the rigid arm in response to manual depression of the finger grip means for release of the connector body and its terminal from the terminal post.

These and other objects and advantages of the invention will be apparent when reference is made to the following description and accompanying drawings, wherein.

Figure 1:
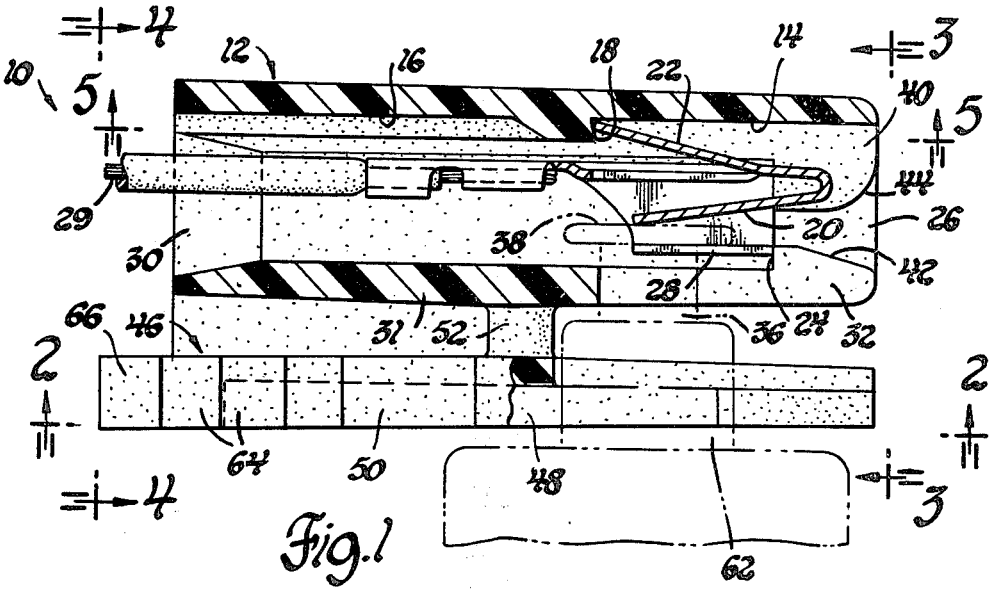
FIG. 1 is a fragmentary cross-sectional view of the invention, including a contact terminal and showing in phantom an external terminal post cooperating therewith.
Figure 2:
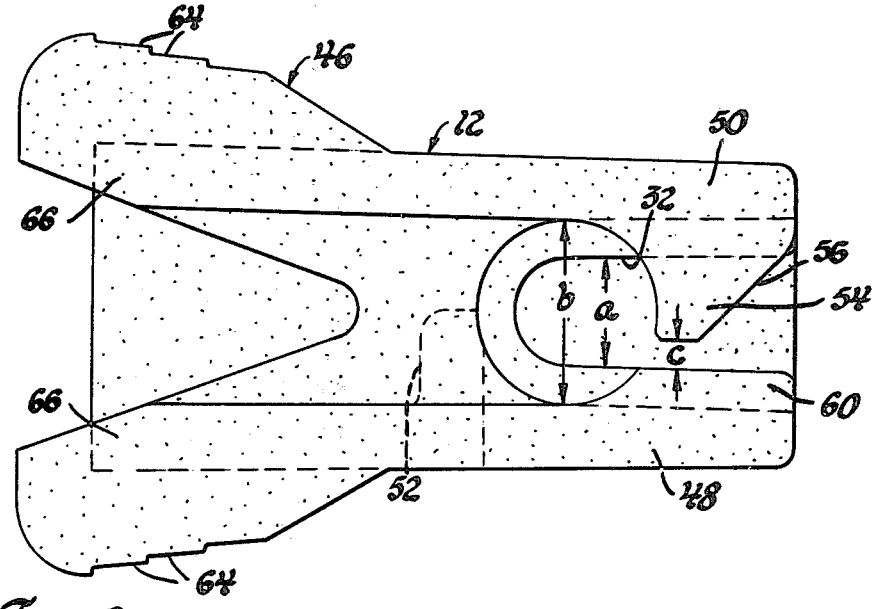
FIGS. 2–4 are respective side elevational and opposite end views taken along the respective planes of lines 2—2, 3—3, and 4—4 of FIG. 1, and looking in the directions of the arrows.
Figure 3:
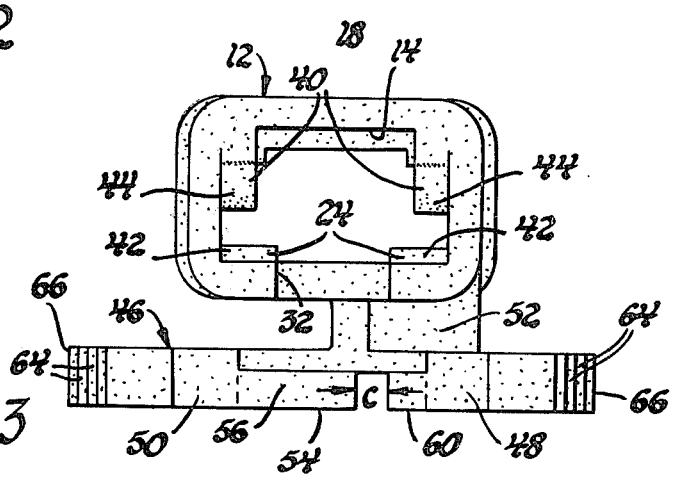
Figure 4:
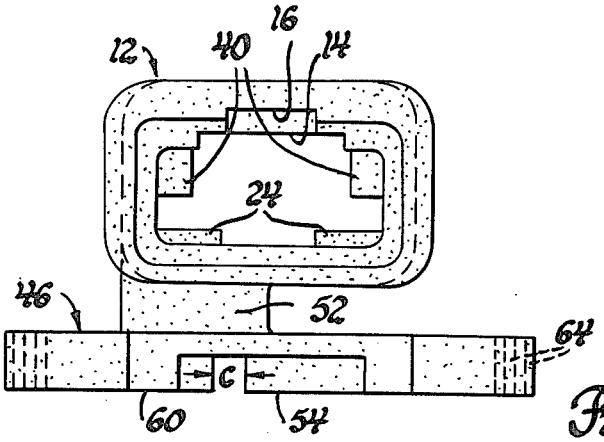
Figure 5:
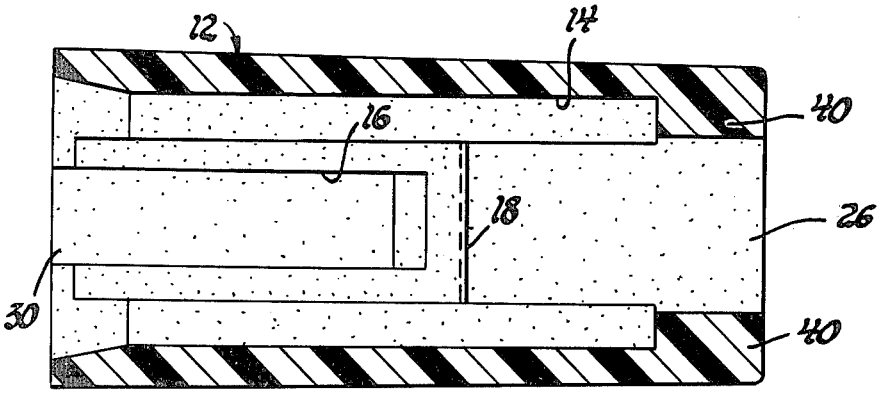
FIG. 5 is a cross-sectional view taken along the plane of the line 5—5 of FIG. 1, and looking in the direction of the arrows.
Figure 6:
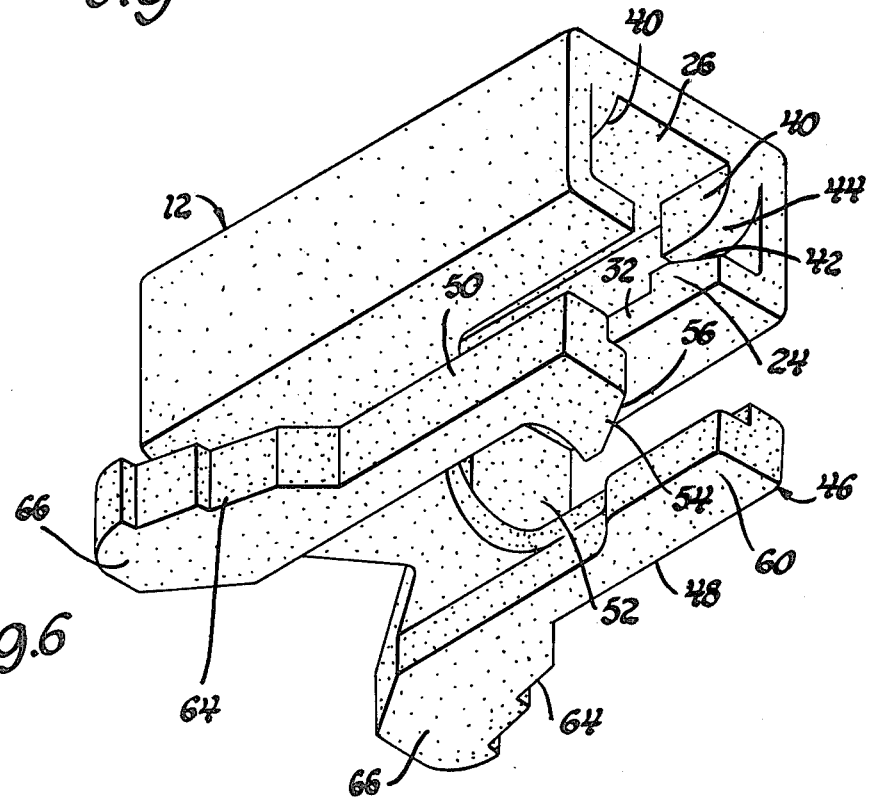
FIG. 6 is a perspective view of the inventive electrical connector.

Referring now to the drawings in greater detail, FIGS. 1–6 illustrate an electrical connector 10 including a hard plastic electrical connector body portion 12 having a longitudinal, rectangular shaped passage 14 (FIGS. 3 and 4) formed therethrough. A longitudinal slot 16 and transverse shoulder 18 (FIGS. 1 and 5) are formed along one wall of the passage 14, adapted to restraining a metal terminal 20 in one axial direction by virtue of a resilient, rearwardly extending tang 22 (FIG. 1) on the terminal 20 having been slid along the slot 16 and then depressed to snap past the shoulder 18. A pair of oppositely disposed projections 24 are formed just inside the front open end 26 of the body portion 12, serving as retention means for edge portions 28 of the terminal 20 in the opposite axial direction. A wire lead 29 extends from the metal terminal 20 through the rear open end 30 of the body portion 12.

A notch 32 of a predetermined width a (FIG. 2) is formed in the body 12 intermediate the projections 24 and extending from the open end 26 of the body portion 12. The notch 32 is adapted to slide onto a conventional external terminal stud or post 36, to bring a contact collar or button 38 formed on the distal end of the post end 36 into contact with the terminal 20. An additional pair of projections 40 are formed adjacent the open end 26 opposite the projections 24. Diverging surfaces 42 and 44 are formed on the respective pairs of projections 24 and 40 to serve as a means for piloting the collar 38 into the notch 32 and into position on the terminal 20.

A lock member portion 46 includes a rigid arm 48 integrally formed along one edge of the connector body, and a movable arm 50 integrally pivotally connected by a stem or abutment 52 at a midpoint thereof to both the connector body wall 31 and the rigid arm 48. The arm 50 extends along the edge opposite the rigid arm so as to provide a space therebetween of a predetermined width b. An inwardly projecting locking corner 54 having a cam surface 56 on the forward face thereof is formed along a portion of the inside surface of the free end of the movable arm 50, adjacent the open-ended notch 30 and extending toward a shelf or ledge 60 formed on the oppositely disposed inside surface of the rigid arm 48. The locking corner 54 and the ledge 60 are spaced a predetermined distance c apart in the free-standing state. The locking corner 54 is adapted to being flexed outwardly, spreading the free-standing space c, by the movement therepast of the base portion 62 (FIG. 1) of the external terminal post 36 until the base portion bottoms in the rear of the space width b, with the locking corner 54 closing behind it. At the same time, the post 36 slides into the notch 32 in the space width a, while the contact button 38 engages the terminal 20, as described above.

Suitable finger grips 64 are formed on the outer edge of the rear end portion 66 of each of the rigid and movable arms 48 and 50, respectively, adapted to pivot the locking corner 54 outwardly away from the rigid arm 48, once again spreading the space width c, in response to manual depression of the finger grips. Such action permits release of the connector body portion 12 from the terminal post 36 by withdrawal of the former from the latter, past the locking corner 54 and the ledge 60. Upon release of the finger grips 64, the locking corner 54 returns to its free-standing position a width c away from the ledge 60.

It should be apparent that the invention provides an improved, simplified and highly efficient one-piece electrical connector, adapted to facilitate rapid engagement and disengagement of the connector with respect to a typical external terminal post.

While but one embodiment of the invention has been shown and described, other modifications thereof are possible.

The embodiments of the invention in which an exclusive property or privilege is claimed are defined as follows:

1. In a hard plastic electrical connector body having a metal terminal secured therein and including an open-ended notch formed in a wall thereof adjacent the terminal for sliding engagement with an external terminal post, the improvement comprising a lock member including a rigid arm integrally formed along one edge of said connector body wall and a movable arm integrally pivotally connected at a midpoint thereof to the connector body wall and the rigid arm and extending along the opposite edge of said wall, an inwardly projecting locking corner formed on the end of the movable arm adjacent the open-ended notch and adapted to being flexed outwardly by the movement therepast of the external terminal post upon the forcing of the connector body onto the terminal post for locking engagement with the terminal, and means formed on the outer edge of the other end of each of the rigid and movable arms adapted to pivot the locking corner outwardly away from the rigid arm in response to manual depression of said means for release of the connector body from the terminal post.

2. In a hard plastic electrical connector body having a metal terminal secured therein and including an open-ended notch formed in a wall thereof adjacent the terminal for sliding engagement with an external terminal post, the improvement comprising a lock member including a rigid arm integrally formed along one edge of said connector body wall and a movable arm integrally pivotally connected at a midpoint thereof to the rigid arm and extending along the opposite edge of said wall, an inwardly projecting locking corner formed on the end of the movable arm adjacent the open-ended notch and adapted to being flexed outwardly by the movement therepast of the external terminal post upon the forcing of the connector body onto the terminal post for locking engagement with the terminal, and finger grips formed on the outer edge of the other end of each of the rigid and movable arms and adapted to being manually squeezed to thereby urge said other end of said movable arm toward said rigid arm and thus pivot the locking corner at the opposite end thereof outwardly away from the rigid arm permitting release of the connector body from the terminal post by withdrawal of the former from the latter past said locking corner.

* * * * *